US008267389B2

(12) United States Patent
Roesch et al.

(10) Patent No.: US 8,267,389 B2
(45) Date of Patent: Sep. 18, 2012

(54) DEVICE FOR APPLYING PRESSURE TO A WORKPIECE

(75) Inventors: Hans Roesch, Gemmrigheim (DE); Rainer Steinle, Denkendorf (DE)

(73) Assignee: BESSEY Tool GmbH & Co. KG, Bietigheim-Bissingen (DE)

( * ) Notice: Subject to any disclaimer, the term of this patent is extended or adjusted under 35 U.S.C. 154(b) by 1163 days.

(21) Appl. No.: 12/072,911

(22) Filed: Feb. 27, 2008

(65) Prior Publication Data

US 2008/0217830 A1 Sep. 11, 2008

(30) Foreign Application Priority Data

Mar. 8, 2007 (DE) ..... 10 2007 012 275

(51) Int. Cl.

| | |
|---|---|
| ***B43L 5/00*** | (2006.01) |
| ***B25B 1/02*** | (2006.01) |
| ***B25B 5/02*** | (2006.01) |
| ***B25B 1/24*** | (2006.01) |
| ***B25B 5/16*** | (2006.01) |
| *B25B 5/10* | (2006.01) |

(52) U.S. Cl. ..... 269/249; 269/166; 269/258; 269/283; 269/88

(58) Field of Classification Search ..... 269/249; 260/166, 258, 283, 45, 88, 147–149, 203, 260/215, 6, 3

See application file for complete search history.

(56) References Cited

U.S. PATENT DOCUMENTS

| | | | | |
|---|---|---|---|---|
| 1,403,580 | A | 1/1922 | Venema | |
| 1,452,753 | A * | 4/1923 | Otto et al. | 269/189 |
| 1,659,342 | A * | 2/1928 | Wetzler | 269/166 |
| 1,689,331 | A * | 10/1928 | Disibio | 269/215 |
| 1,741,923 | A * | 12/1929 | Dohnal | 269/171.5 |
| 1,793,560 | A * | 2/1931 | Schmieder | 269/37 |
| 1,793,561 | A * | 2/1931 | Schmieder | 269/37 |
| 2,168,257 | A * | 8/1939 | Farmer | 269/171.5 |
| 2,675,839 | A * | 4/1954 | Beasley | 269/208 |
| 2,894,548 | A * | 7/1959 | Peck et al. | 269/258 |
| 3,052,462 | A | 9/1962 | Butler | |
| 3,336,642 | A * | 8/1967 | Armacost | 24/523 |
| 4,034,971 | A * | 7/1977 | Tsuyama | 269/249 |
| 5,427,364 | A * | 6/1995 | Zborschil | 269/166 |
| 6,113,089 | A * | 9/2000 | Kleinbongartz | 269/166 |
| 6,123,326 | A * | 9/2000 | Kleinbongartz | 269/215 |
| 6,485,218 | B1 | 11/2002 | Martinovsky | |
| D467,152 | S * | 12/2002 | Wolff | D8/72 |
| 6,971,641 | B1 * | 12/2005 | Sherwin | 269/166 |
| 7,644,500 | B2 * | 1/2010 | Schmidt et al. | 29/898.044 |
| 2004/0046300 | A1 * | 3/2004 | Degen | 269/166 |

FOREIGN PATENT DOCUMENTS

CH 345 621 5/1960

(Continued)

*Primary Examiner* — Lee D Wilson

*Assistant Examiner* — Alvin Grant

(74) *Attorney, Agent, or Firm* — Lipsitz & McAllister, LLC

(57) ABSTRACT

In a device for applying pressure to a workpiece comprising a contacting element for a workpiece, a holding device and a bearing device by means of which the contacting element is retained on the holding device, wherein the bearing device comprises a holding head and a holding head seating space, and wherein the holding head seating space has a bearing portion for the holding head, it is provided that the bearing device comprises a bearing shell which is a part separate from the holding head and the holding head seating space, and that the bearing is fixed on the holding head seating space and forms the bearing portion.

38 Claims, 2 Drawing Sheets

FOREIGN PATENT DOCUMENTS

| | | |
|---|---|---|
| DE | 929 357 | 6/1955 |
| DE | 18 47 400 | 2/1962 |
| DE | 74 02 870 | 6/1974 |
| DE | 197 51 599 | 5/1999 |
| DE | 198 13 929 | 10/1999 |
| EP | 0 461 994 | 12/1991 |
| EP | 0 924 441 | 6/1999 |
| WO | 02/051590 | 7/2002 |

* cited by examiner 10
14
16
18
22
24
50
48
46
34
28
12
20
26
30
32

DEVICE FOR APPLYING PRESSURE TO A WORKPIECE

The present disclosure relates to the subject matter disclosed in German application number 10 2007 012 275.8 of Mar. 8, 2007, which is incorporated herein by reference in its entirety and for all purposes.

BACKGROUND OF THE INVENTION

The invention relates to a device for applying pressure to a workpiece comprising a contacting element for a workpiece, a holding device and a bearing device by means of which the contacting element is retained on the holding device, wherein the bearing device comprises a holding head and a holding head seating space, and wherein the holding head seating space has a bearing portion for the holding head.

Such a device for applying pressure to a workpiece is in the form of a cramp or clamp (such as a screw clamp or a lever clamp) for example. The contacting element transfers compressive forces to the workpiece and is thereby subjected to wear.

From DE 18 47 400 U1, there is known a clamping device which comprises a pressure-exerting piece that ends in a ball. Furthermore, a pressure plate is provided which is fixed to the ball of the pressure exerting piece in detachable manner. A spring is provided as a means for the detachable fixation of the pressure plate.

From DE-Patent 929 357, there is known a screw cramp having mounting devices in the form of rotatable bearings that are arranged on the two pressure plates and are provided for replaceable and rotatable pressure pads serving as work holders. The rotatable bearings for these pressure pads are in the form of thrust bearings.

From DE 74 02 870 U1, there is known a clamping tool incorporating a threaded spindle and a pressure cap. The pressure cap surrounds a head of the threaded spindle in positive manner by means of a bearing socket. A spring washer or snap ring forms the edge of the bearing socket.

From DE 197 51 599 A1, there is known a screw cramp which comprises a pressure plate that is fixed to a threaded spindle in pivotal manner. The pressure plate can be straightened up with the aid of a locking device and lock a spindle on an upper surface of a sliding clamp.

From U.S. Pat. No. 3,052,462, there is known a C-clamp incorporating a screw, wherein the screw carries a ball head. A pressure head is seated on the ball head. This pressure head has a boring and an annular groove by means of which there is defined a lip that is connected by a neck to the other part of the body of the pressure head.

SUMMARY OF THE INVENTION

In accordance with the present invention, a device for applying pressure to a workpiece is provided, which can be produced in a simple manner.

In accordance with an embodiment of the invention, the bearing device comprises a bearing shell which is a part separate from the holding head and the holding head seating space, and the bearing shell is fixed on the holding head seating space and forms the bearing portion.

The contacting element and the bearing shell can be manufactured separately. The overall production process is thus made simpler and the bearing device can be optimised.

Due to the separate bearing shell, the bearing portion on the contacting element no longer has to be manufactured by means of a turning process (as for example by being hollowed out using a profiling tool), this accordingly being a complex process. The bearing shell can be manufactured in a simple manner and in particular in non-cutting manner by a pressing process for example.

Furthermore, it is possible to use a low friction material (low static friction and sliding friction) for the bearing shell. When producing a bearing portion by means of a turning process, one obtains a middling or rough surface quality with correspondingly higher frictional values. In the case of the solution in accordance with the invention wherein the bearing shell is a separate part, optimal results can be achieved here. For example, the bearing shell can be made from a sintered metal.

There is no noticeable loss of clamping force due to bearing wear (which increases the friction) even after a large number of clamping actions when the device for applying pressure to a workpiece is in the form of a clamp clip.

It is also possible for example to produce a contact area of the contacting element from a weldable material (which is usually soft and has a high frictional value and a low abrasion resistance), and to make the bearing portion from a suitable material having a smaller coefficient of friction.

Hereby, provision may be made for the holding head seating space to be formed on the contacting element and for the holding head space to be formed on the holding device.

Alternatively, it is possible for the holding head seating space to be formed on the holding device and for the holding head space to be formed on the contacting element.

It is expedient if the bearing shell is positioned such as to be non-rotatable with respect to the holding head seating space. A degree of movement of the contacting element (which, in particular, is in the form of a pressure cap) with respect to the holding device can thereby be achieved in a simple manner, whereby this degree of movement is realized by means of the bearing shell.

For example, the bearing shell is held in non-rotatable manner by means of a frictional connection and/or an interlocking connection. In the case of a frictional connection for example, the bearing shell is pressed against a boundary of a seating space for the bearing shell and a state of non-rotatability is thereby achieved. An interlocking connection can be obtained for example by means of appropriate interlocking connection elements on the bearing shell and a boundary of a seating space for the bearing shell.

Provision may be made for the bearing shell to comprise an upper edge region which overlaps a wall that bounds a seating space for the bearing shell. A force can be exerted on the upper edge region by a securing element in order to press the bearing shell against a boundary of the seating space for the bearing shell. Non-rotatable fixing of the bearing shell can thus be realized in a simple manner.

In particular, the holding head seating space is bounded by the bearing portion and in particular the bearing shell. The holding head can thereby come into mechanical contact with the bearing portion when a compressive force is exerted.

In particular, there is provided a seating space for the bearing shell which is bounded by a surrounding wall. The bearing shell can be positioned in the latter.

Hereby, provision may be made for the surrounding wall to comprise an end face region which is adapted to be overlapped by the bearing shell.

In one advantageous embodiment, the surrounding wall is provided with an external thread. A securing element, by means of which lifting of the holding head from the holding head seating space is adapted to be blocked, can be fixed by means of the external thread. The holding head can thereby be held in the holding head seating space.

It is especially advantageous if the bearing portion comprises a spherical surface facing the holding head. Forces can then be optimally distributed in order to obtain high abrasion resistance for the bearing device.

In particular, the holding head is in the form of a ball head. One thereby obtains an optimised distribution of the forces. Furthermore, sealing of a gap between the holding head and the holding head seating space (towards the exterior) can then be obtained in a simple manner in order to prevent the outflow of a lubricant.

It is especially advantageous if the holding head is retained in the holding head seating space in pivotal and/or rotatable manner. The contacting element can then be rotated and/or pivoted with respect to the holding device. Alignment of the contacting element with respect to a workpiece is thereby possible.

In particular, the holding head is retained in the holding head seating space with free play. The holding head and the holding head seating space are dimensioned accordingly. It can thereby be ensured that the lubricant can be redistributed in order to achieve an optimal lubrication effect.

It is especially advantageous if the bearing portion comprises a lubricant reservoir. A larger quantity of lubricant can thereby be held in readiness on the bearing device.

In particular, the lubricant reservoir is formed by at least one recess. The recess can be at least partly filled with lubricant during the production of the bearing device.

It is advantageous if the lubricant reservoir is arranged centrally on an axis of symmetry of the holding head seating space. There can thus be provided a lubricant reservoir which does not disturb the force flow between the holding device and the contacting element.

It is expedient if the holding head is prevented from lifting out of the holding head seating space by means of a securing element. The securing element ensures that the contacting element is fixed on the holding head (whereby rotary and/or pivotal movement is still allowable).

In a technically expedient embodiment, the securing element is in the form of a counter element for the bearing shell and presses against the bearing shell. Due to the securing element on the one hand, the contacting element can be held on the holding head "in loss-secure manner". On the other hand, a compressive force can be exerted via the securing element serving as a counter element on the bearing shell in order to press the latter against a boundary of a seating space for the bearing shell. The bearing shell can thus be fixed in non-rotatable manner with respect to the seating space for the bearing shell without further effort.

It is expedient if the securing element comprises a contact area for the bearing shell. A compressive force can be exerted on the bearing shell by the securing element by means of this contact area. In particular, a compressive force can be exerted on an upper edge region (outside a spherical surface of the bearing shell).

It is especially advantageous if the securing element is connected to a wall which surrounds the holding head seating space. The connection can be effected by means of a screwed, latching or flanging connection for example. In particular, the connection is provided in such a way that it is releasable. The contacting element can then be removed and replaced.

In one exemplary embodiment, the securing element is screwed to the wall.

It is expedient if the securing element is a nut. Due to the force applied by the screwing process, the bearing shell can be fixed in non-rotatable manner at the same time.

It is expedient if the securing element projects beyond an equatorial plane of the holding head when this is in the form of a ball head. A locking action can then be achieved in a simple manner. Furthermore, a gap between the holding head and the holding head seating space can be sealed towards the exterior in order to prevent the outflow of a lubricant.

In particular, the securing element is provided in the form of a sealing (towards the exterior) for a space between the holding head seating space and the holding head and/or comprises a sealing for this space. Thus discharge of lubricant can be prevented in an effective and simple manner. An additional seal, which is arranged in the securing element, can, for example, be obtained by means of one or more peripheral sealing lips. By virtue of such sealing lips, the effect can also be achieved that a certain position of the contacting element relative to the holding head is fixed in frictional manner, and an appropriate application of force is necessary in order to produce another pivotal position or rotary position.

In particular, the securing element comprises an opening through which the holding head is guided. Lifting of the holding head from the holding head seating space is then blocked due to the fact that-the holding head strikes against a boundary of the opening.

It is especially advantageous if the bearing shell is manufactured in a non-cutting manner. One thereby obtains a surface of high quality with correspondingly lower friction. Thus, in turn, a lower loss of clamping force over the number of clamping actions can be achieved using a simple fabrication process.

It is especially advantageous, if the bearing shell is manufactured by a pressing process. Production is thereby possible in a simple and economical manner.

A long life span for the bearing device with the least amount of degradation of the clamping force can be achieved if the bearing portion is manufactured as a sintered bearing portion. The bearing portion can thereby be formed on the bearing shell or directly on the contacting element without provision of a bearing shell. If the bearing portion is in the form of a sintered bearing portion, then a high quality surface with a correspondingly low degree of friction can be obtained.

In particular, the bearing portion is a powder metallurgical portion. It is manufactured using a powder metallurgical process. For example, it is manufactured by a pressing process and subsequently baked.

For example, the bearing portion is made from sintered steel which is case-hardened for example. One thereby obtains high surface hardness and also a high quality surface.

Provision may also be made for the bearing portion to be made of a porous material. For example, a porous sintered material is employed.

It is possible for the pores to be impregnated with a lubricant. One thereby obtains low frictional values and hence a long life span with a low loss of clamping force over this life span. Moreover, this provides good emergency running properties, i.e. the operability of the arrangement is maintained even after the lubricant has washed away (since the lubricant is bound in the pores through capillary action).

In particular, the bearing shell is a powder metallurgical part. Such a powder metallurgical part can be manufactured in a simple manner by a pressing and baking process. A high quality surface with correspondingly low friction can be realized. Thus, in turn, it is possible to achieve a relatively low loss of clamping force over the life span.

It is expedient if the wall thickness of the bearing shell is substantially uniform. The bearing shell can therefore be manufactured in a simple manner in the form of a pressed part. Thus in turn, the manufacturing costs are capable of being minimized.

Provision may be made for the contacting element to have a contact area of a weldable material. It is thereby possible to weld the contacting element to an appropriate workpiece during the application thereof. In particular, if the bearing portion is realized by a bearing shell, then an appropriate material can be used for the contacting element without compromises having to be made in regard to the bearing device.

Provision may be made for the bearing device to be formed in such a manner that the contacting element is removable. Thus, for example, replacement of a spindle can be accomplished in a simple manner or a worn out contacting element can be exchanged in a simple manner. Furthermore, it is also possible to use a contacting element adapted to the particular application. For example, a contacting element can then be used wherein the size of the contact surface is adapted to the particular application.

The device for applying pressure to a workpiece is, in particular, in the form of a clamping tool for clamping one or more workpieces. For example, it may be provided in the form of a cramp (such as a screw clamp or a lever clamp).

Thereby, provision may be made for the holding device to be a spindle (such as a threaded spindle) or be formed on a spindle.

The following description of preferred embodiments serves for a more detailed explanation of the invention taken in conjunction with the drawings.

DETAILED DESCRIPTION OF THE INVENTION

Figure 1:
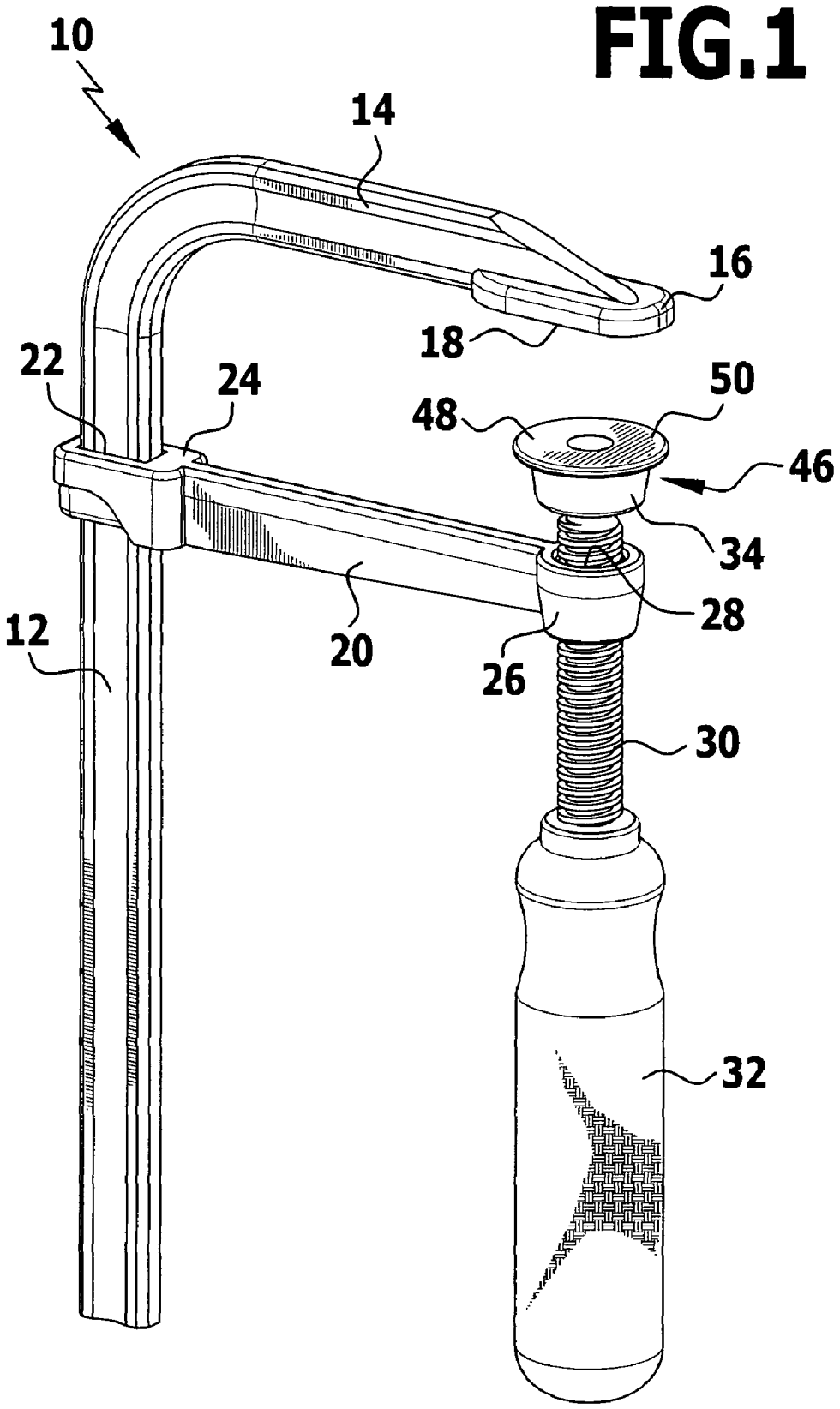
FIG. 1 shows a perspective illustration of an exemplary embodiment of a clamping tool as an example of a device for applying pressure to a workpiece in accordance with the invention.

An exemplary embodiment of a device for applying pressure to a workpiece is a clamping tool which is shown in FIG. 1 and bears the general reference 10 therein. The exemplary embodiment shown is a screw cramp (clamp). The screw clamp 10 is a hand tool and comprises a rail 12 on which a fixed clamping arm 14 is arranged. The fixed clamping arm 14 has a contact area 16 for a workpiece. This contact area 16 has a substantially flat contact surface 18.

A sliding clamping arm 20 is guided on the rail 12. The sliding clamping arm 20 comprises a recess 22 which is formed in a holding element 24. The sliding clamping arm 20 is guided on the rail 12 by the holding element 24. Hereby, the holding element 24 is formed in such a way that it can tilt on the rail 12.

The fixed clamping arm 14 and the sliding clamping arm 20 are aligned at least approximately parallel to one another.

The sliding clamping arm 20 comprises a threaded element 26 having an internal thread 28 at an end thereof opposite the holding element 24. A threaded spindle 30 is guided in the internal thread 28. A handle element 32 is seated on the threaded spindle 30.

Figure 2:
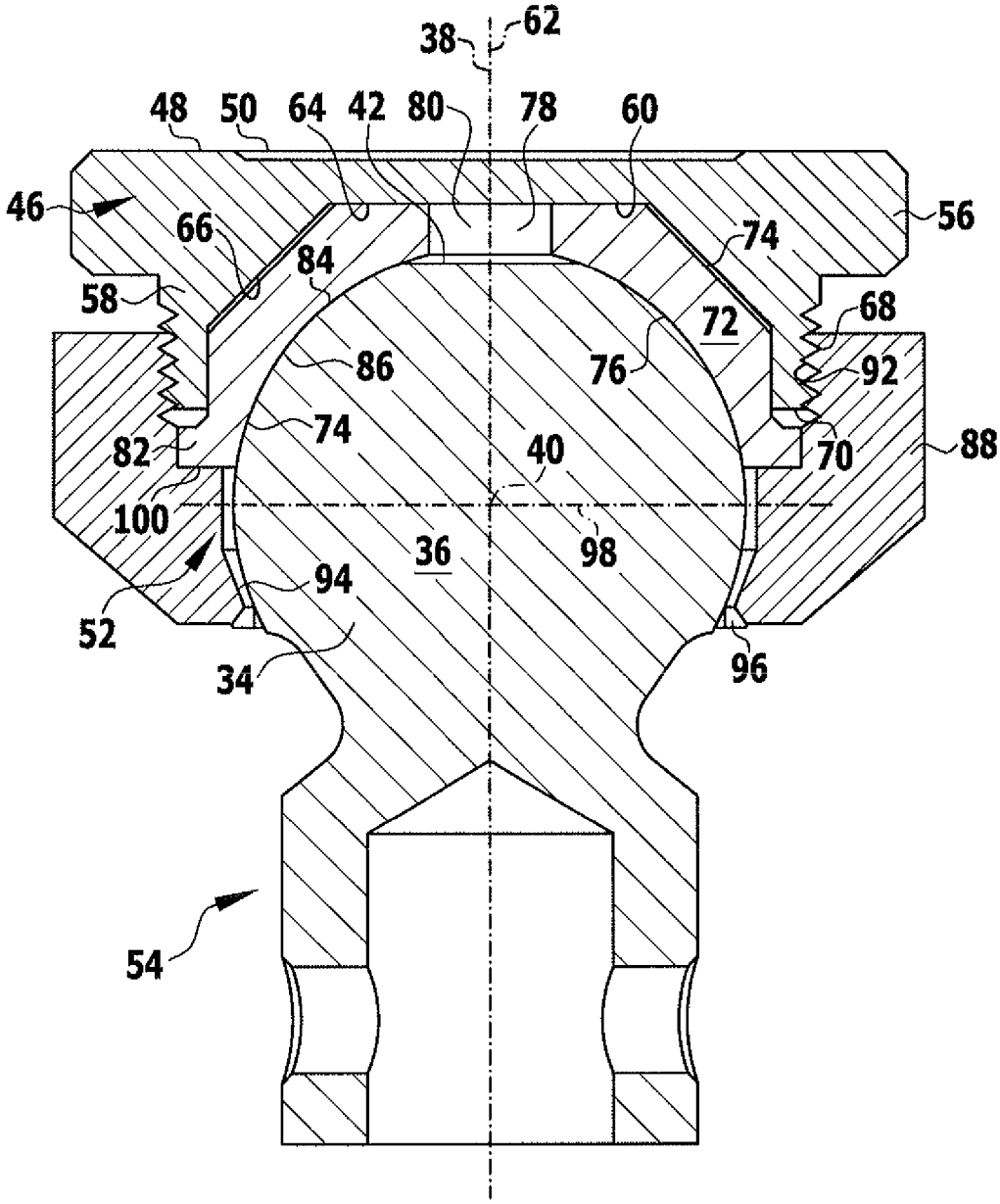
FIG. 2 a sectional side view of an exemplary embodiment of a device for applying pressure to a workpiece in accordance with the invention.

The threaded spindle 30 comprises a holding head 34, which is particularly in the form of a ball head 36, at the end opposite the handle element 32 (FIG. 2). The threaded spindle 30 extends along an axis 38 which is coaxial with an axis of rotation of the threaded spindle 30. A centre point 40 of the ball head 36 lies on the axis 38.

In the exemplary embodiment shown, the ball head 36 has a substantially flat end face 42 so that it is in the form of a segment of a sphere in this area.

A removable, and in particular, manually removable contacting element 46 is arranged on the holding head 34. This comprises a contact area 48 which is adapted to be applied to a workpiece by means of a contact surface 50. The contact surface 50 is substantially flat. It is aligned with the contact surface 18 of the fixed clamping arm 14.

By means of the threaded spindle 30 a compressive force can be exerted on a work piece having a side thereof resting against the fixed clamping arm 14 by means of a threaded spindle 30. The workpiece can thus be clamped. (In this sense, the compressive force can also be regarded as a clamping force.)

The contacting element 46, which is provided in the form of a pressure cap in particular, is held on a holding device 54 by means of a bearing device which bears the general reference 52 in FIG. 2. The holding device 54 is the threaded spindle 30 or is held on the threaded spindle 30. The holding device 54 comprises the holding head 34.

The contacting element 46 has an end face disk 56 on which the contact area 48 is formed. A surrounding wall 58 is arranged on the end face disk 56 and is formed, in particular, in one-piece manner. The wall 58 surrounds a recess or a space 60. This space 60 is rotationally symmetrical about an axis 62. (It is possible for the axis 62 and the axis 38 to coincide by appropriate alignment of the contacting element 46.)

The space 60 is bounded by a first region 64 which is transverse and in particular perpendicular to the axis 62. This first region 64 has an outline in the form of a circle. Adjoining the first region 64, there is a second region 66 which is inclined with respect to the first region 64. The inclination is rotationally symmetrical about the axis 62 and has an (imaginary) cone tip on the axis 62 outside the contacting element 46 (before the contact surface 50).

The surrounding wall 58, which projects from the end face disk 56, comprises an external thread 68. It has an end face region 70 which is annular. This end face region 70 is formed on a side of the contacting element 46 which is remote from the contact surface 50.

A bearing shell 72 is positioned in the space 60. This space 60 is a seating space for the bearing shell 72. This bearing shell 72 is a part which is manufactured separately from the holding head 34 and the contacting element 46 and which is positioned in the space 60 during the production of the bearing device 52 and is retained therein in non-rotatable manner.

The bearing shell 72 has a first side 74 which faces the first region 64 and the second region 66 of the boundary of the space 60. Furthermore, it has a second side 76 which faces the holding head 34. The first side 74 has the surface of a truncated cone with the same amount of taper as the second region 66. The bearing shell 72 is arranged to be applied to the first region 64 and the second region 66 by means of the first side 74. The second side 76 has a spherical surface for the purposes of forming a spherical bearing for the ball head 36.

The bearing shell 72 comprises a lubricant reservoir 78 which can receive lubricant. This lubricant reservoir 78 is formed, in particular, in a central region of the bearing shell around the axis 62 (with respect to which the bearing shell 72 is rotationally symmetrical) by an appropriate recess 80.

The bearing shell 72 has an upper edge region 82 with which it overlaps the end face region 70 of the surrounding wall 58.

A bearing portion 84, which can come into mechanical contact with the holding head 34, is defined by the bearing shell 72. The bearing portion 84 bounds a holding head seating space 86 in which the holding head 34 is at least partially seated.

A securing element 88 is fixed to the wall 58. This securing element 88 prevents the holding head 34 that is positioned in the holding head seating space 86 from being lifted out of this. The securing element 88 is, in particular, a nut which is screwed onto the wall 58 by means of its internal thread 92.

It is also possible for there to be other ways of connecting and fixing the securing element 88 to the wall 58. For example, it is possible to provide a connection by a latching or flaring process.

The securing element 88 has an opening 94 through which the holding head 34 is passed. The opening 94 is adapted to the shape of the holding head 34 and in particular, to the spherical shape thereof in such a manner that a gap between the bearing shell 72 and the holding head 34 is sealed towards the exterior (towards the threaded spindle 30) so that the lubricant is prevented from flowing out or at least the outflow thereof is reduced. In addition, further sealing can also be provided by means of one or more sealing lips 96 for example.

The opening 94 in the securing element 88 projects beyond an equatorial plane 98 of the holding head 34 so that lifting thereof out of the holding head seating space 86 is blocked by an interlocking arrangement (by virtue of it resting against the securing element 98 within the area of the opening 94).

Furthermore, the securing element 88 has a contact area 100 which, in particular, is annular. This serves for the placement on the upper edge region 82 of the bearing shell 72. With the aid of the securing element 88 which then acts as a counter element for the bearing shell 72, the latter can be pressed into the seating space 60 and thus be held in non-rotatable manner with respect to the contacting element 46 by means of a frictional connection.

The bearing device 52 is constructed in such a manner that the holding head 34 and the contacting element 46 are mutually relatively rotatable and pivotal. The contacting element 46 is rotatable about an axis of rotation that is coaxial with the axis 62. Furthermore, the contacting element 46 is pivotal about each respective pivotal axis which is perpendicular to the axis 62 and passes through the centre point 40. The maximum pivotal angle lies in the order of magnitude of approximately 35° for example.

The contacting element 46 is connected to the holding device 54 in releasable manner by means of a screw-type connection of the securing element 88 to the wall 58. It can be removed and exchanged.

The bearing shell 72 is manufactured, in particular, by a non-cutting process. In order to manufacture the bearing portion without additional bearing shells 72 having a spherical surface, a relatively high amount of processing is necessary. A cone surface has to be prepared by a metal removing process, whereby subsequent machining is necessary. The surface quality of the corresponding turned parts, which were worked on with a profiling tool, is middling or rough. In the case of the solution in accordance with the invention, there is provided an additional bearing shell 72 which is manufactured separately. This, for example, can be manufactured with a high quality surface in non-cutting manner by means of a pressing process. The amount of processing is thereby significantly reduced.

In particular, the bearing shell 72 is manufactured in such a way that it has a substantially uniform wall thickness. Production by a pressing process is thereby possible in a simple manner.

Provision is made, in particular, for the bearing shell 72 to be manufactured in such a way that a sintered bearing is formed. The bearing shell 72 is a part produced in a powder-metallurgical process which is made, in particular, from a case-hardened sintered steel. For example, in the production process, an appropriate pre-form is produced by a pressing process and this is then baked.

It is possible here, for the material of the bearing shell 72 to exhibit porosity. The pores can be impregnated with lubricant in order to enable the bearing device 52 to be permanently lubricated.

Apart from a simpler manufacturing process, better frictional values can be obtained by the use of a bearing shell 72 which, in particular, is a part produced in a powder-metallurgical process. The static friction and the sliding friction can be reduced. In consequence, one obtains a substantially unchanged clamping force even after a high number of clamping actions. For example, the result of several trials was that by using the solution in accordance with the invention, the clamping force did not substantially decrease even after 50 clamping actions. (The trials were carried out with a screw cramp having a jaw gap of 150 mm and a torque of 40 Nm. A 30/50 rail was employed. The clamping force amounted thereby to 12000 N. Even after 50 clamping actions, a clamping force of 12000 N could still be measured.)

Since the bearing shell 72 can be manufactured by a non-cutting process, one obtains a higher quality of surface than for a corresponding turned part.

In the case of the solution in accordance with the invention, it is also possible for the contact area 48 of the contacting element to be made of a weldable structural steel for example. Due to the bearing shell 72, the bearing portion 84 can be manufactured from an appropriate material that is more advantageous for the bearing. (Weldable structural steel is fundamentally soft, so that there is a high degree of friction and durability is reduced.)

In accordance with the invention, there is provided a device for applying pressure to a workpiece which is producible in a simple manner and which does not exhibit a noticeable loss of clamping force even for a high number of clamping actions, i.e. there is no noticeable increase of friction due to bearing wear.

Due to the solution in accordance with the invention, a clamping tool such as a screw clamp or a lever clamp for example can be realized in a simple manner. The contacting element 46 (which, in particular, is in the form of a pressure cap) can be replaced in a simple manner.

The device for applying pressure to a workpiece may also comprise a plurality of contacting elements on a holding device or on a plurality of holding devices.

In the exemplary embodiment 10, the holding head 34 is formed on the holding device 54 and the holding head seating space 86 is formed on the contacting element 46. It is in principle also possible for the holding head seating space to be formed on the holding device and for the holding head to be formed on the contacting element 46.

In a further embodiment of the solution in accordance with the invention, the bearing portion of the bearing device 52, which comes into contact with the holding head 34, is formed by a powder metallurgical material and in particular sintered steel. A sintered bearing for supporting the holding head 34 is provided. The bearing portion can be arranged directly on the contacting element 46 in one-piece manner or be in multi-part form. A separate bearing shell does not have to be provided. For example, a plurality of separate bearing portion elements can be provided, these being fixed to the contacting element and together they form the bearing portion.

It is in principle also possible for the contacting element to be made in one-piece manner from the appropriate material.

The invention claimed is:

1. A device for applying pressure to a workpiece, comprising:

a contacting element for a workpiece;

a holding device; and a bearing device by means of which the contacting element is mounted on the holding device;

wherein:

the bearing device comprises a bearing shell, a holding head and a holding head seating space;

the holding head seating space has a bearing portion for the holding head;

the bearing shell is a part separate from the holding head and the holding head seating space;

the bearing shell is fixed on the holding head seating space and forms the bearing portion;

the bearing portion comprises a porous material; and pores of the porous material are impregnated with lubricant.

2. A device for applying pressure to a workpiece in accordance with claim 1, wherein either the holding head seating space is formed on the contacting element and the holding head is formed on the holding device or the holding head seating space is formed on the holding device and the holding head is formed on the contacting element.

3. A device for applying pressure to a workpiece in accordance with claim 1, wherein the bearing shell is positioned such as to be non-rotatable with respect to the holding head seating space.

4. A device for applying pressure to a workpiece in accordance with claim 3, wherein the bearing shell is held in non-rotatable manner by means of at least one of a frictional connection and an interlocking connection.

5. A device for applying pressure to a workpiece in accordance with claim 4, wherein the bearing shell comprises an upper edge region which overlaps a wall that bounds a seating space for the bearing shell.

6. A device for applying pressure to a workpiece in accordance with claim 1, wherein the holding head seating space is bounded by the bearing portion.

7. A device for applying pressure to a workpiece in accordance with claim 1, wherein a seating space for the bearing shell is bounded by a surrounding wall.

8. A device for applying pressure to a workpiece in accordance with claim 7, wherein the surrounding wall comprises an end face region which is arranged to be overlapped by the bearing shell.

9. A device for applying pressure to a workpiece in accordance with claim 7, wherein the surrounding wall is provided with an external thread.

10. A device for applying pressure to a workpiece in accordance with claim 1, wherein the bearing portion comprises a spherical surface facing the holding head.

11. A device for applying pressure to a workpiece in accordance with claim 1, wherein the holding head is in the form of a ball head.

12. A device for applying pressure to a workpiece in accordance with claim 1, wherein the holding head is mounted in the holding head seating space in at least one of a pivotal and a rotatable manner.

13. A device for applying pressure to a workpiece in accordance with claim 1, wherein the holding head is mounted in the holding head seating space with free play.

14. A device for applying pressure to a workpiece in accordance with claim 1, wherein the bearing portion has a lubricant reservoir.

15. A device for applying pressure to a workpiece in accordance with claim 14, wherein the lubricant reservoir is formed by at least one recess.

16. A device for applying pressure to a workpiece in accordance with claim 14, wherein the lubricant reservoir is arranged centrally on an axis of symmetry of the holding head seating space.

17. A device for applying pressure to a workpiece in accordance with claim 1, wherein:

the holding head is prevented from lifting out of the holding head seating space by means of a securing element; and the securing element is formed by a portion of the bearing device.

18. A device for applying pressure to a workpiece in accordance with claim 17, wherein the securing element is in a form of a counter element for the bearing shell and presses against the bearing shell.

19. A device for applying pressure to a workpiece in accordance with claim 17, wherein the securing element has a contact area for the bearing shell.

20. A device for applying pressure to a workpiece in accordance with claim 18, wherein the securing element is connected to a wall which surrounds the holding head seating space.

21. A device for applying pressure to a workpiece in accordance with claim 20, wherein the securing element is screwed to the wall.

22. A device for applying pressure to a workpiece in accordance with claim 17, wherein the securing element is a nut.

23. A device for applying pressure to a workpiece in accordance with claim 17, wherein the securing element projects beyond an equatorial plane of the holding head when the holding head is in a form of a ball head.

24. A device for applying pressure to a workpiece in accordance with claim 17, wherein the securing element is in a form of a sealing element for a space between the holding head seating space and the holding head and/or comprises a sealing element for the space.

25. A device for applying pressure to a workpiece in accordance with claim 17, wherein the securing element has an opening through which the holding head is guided.

26. A device for applying pressure to a workpiece in accordance with claim 1, wherein the bearing shell is manufactured by a non-cutting process.

27. A device for applying pressure to a workpiece in accordance with claim 1, wherein the bearing shell is manufactured by a pressing process.

28. A device for applying pressure to a workpiece in accordance with claim 1, wherein the bearing portion is manufactured as a sintered bearing portion.

29. A device for applying pressure to a workpiece comprising:

a contacting element for a workpiece;

a holding device; and a bearing device by means of which the contacting element is mounted on the holding device;

wherein:

the bearing device comprises a holding head and a holding head seating space;

the holding head seating space has a bearing portion for the holding head;

the bearing portion is manufactured as a sintered bearing portion;

the bearing portion comprises a porous material; and pores of the porous material are impregnated with lubricant.

30. A device for applying pressure to a workpiece in accordance with claim 29, wherein the bearing portion is a powder metallurgical portion.

31. A device for applying pressure to a workpiece in accordance with claim 29, wherein the bearing portion is made from sintered steel.

32. A device for applying pressure to a workpiece in accordance with claim 29, wherein:

the bearing device further comprises a bearing shell which is a part separate from the holding head and the holding head seating space; and the bearing shell is a powder metallurgical part.

33. A device for applying pressure to a workpiece in accordance with claim 29, wherein:

the bearing device further comprises a bearing shell which is a part separate from the holding head and the holding head seating space; and the wall thickness of the bearing shell is substantially uniform.

34. A device for applying pressure to a workpiece in accordance with claim 29, wherein the contacting element has a contact area of a weldable material.

35. A device for applying pressure to a workpiece in accordance with claim 1, wherein the bearing device is formed in such a manner that the contacting element is removable.

36. A device for applying pressure to a workpiece in accordance with claim 1, said device being in the form of a clamping tool.

37. A device for applying pressure to a workpiece in accordance with claim 1, said device being in the form of a clamp.

38. A device for applying pressure to a workpiece in accordance with claim 1, wherein the holding device is a spindle or is arranged on a spindle.

* * * * *